US005455010A

United States Patent [19]

Lomas et al.

[11] Patent Number: 5,455,010

[45] Date of Patent: Oct. 3, 1995

[54] FCC PROCESS WITH TOTAL CATALYST BLENDING

[75] Inventors: David A. Lomas, Barrington; David A. Wegerer, Lisle, both of Ill.

[73] Assignee: UOP, Des Plaines, Ill.

[21] Appl. No.: 234,769

[22] Filed: Apr. 28, 1994

Related U.S. Application Data

[62] Division of Ser. No. 125,723, Sep. 24, 1993, Pat. No. 5,346,613.

[51] Int. Cl.[6] ..... F27B 15/08; F28D 7/00

[52] U.S. Cl. ..... 422/144; 422/145; 422/147; 422/235

[58] Field of Search ..... 422/143, 144, 422/145, 146, 147, 234, 235; 208/113, 127, 163, 164

[56] References Cited

U.S. PATENT DOCUMENTS

| | | | |
|---|---|---|---|
| 2,451,619 | 10/1948 | Hengstebeck | 196/52 |
| 3,821,103 | 6/1974 | Owen et al. | 208/72 |
| 3,926,778 | 12/1975 | Owen et al. | 208/74 |
| 4,118,337 | 10/1978 | Gross et al. | 252/417 |
| 4,285,908 | 8/1981 | Thompson et al. | 422/143 |
| 4,481,103 | 11/1984 | Krambeck et al. | 208/120 |
| 4,917,790 | 4/1990 | Owen | 208/113 |
| 4,960,503 | 10/1990 | Haun et al. | 208/85 |
| 4,961,907 | 10/1990 | Herbst et al. | 422/144 |
| 4,963,328 | 10/1990 | Haddad et al. | 422/144 |
| 4,965,232 | 10/1990 | Mauleon et al. | 502/43 |
| 4,973,452 | 11/1990 | Owen | 422/145 |
| 5,017,343 | 5/1991 | Cetinkaya | 422/140 |

*Primary Examiner*—Robert J. Warden
*Assistant Examiner*—Christopher Y. Kim
*Attorney, Agent, or Firm*—Thomas K. McBride; John G. Tolomei

[57] ABSTRACT

An FCC process decouples the circulation of catalyst on the regeneration side of the process from the circulation of catalyst on the reactor side of the FCC process by mixing the spent and regenerated catalyst from the reactor and regenerator side of the process in a common blending vessel that receives all of the spent and regenerated catalyst from the reactor and regenerator. The blending vessel supplies blended catalyst to raise the solids to oil ratio on the reaction side of the process and regulate catalyst temperatures on the reaction and the regeneration sides of the process. The blending vessel can also retain the majority of the catalyst inventory for both the reactor and regenerator sides of the process. Moreover, by the introduction of a stripping gas into the blending vessel it operates as a hot stripper to remove additional hydrocarbons from the blended catalyst that enters the regeneration zone. The blended catalyst also has a relatively high temperature that benefits the process by allowing rapid initiation of coke combustion in the regeneration zone.

9 Claims, 2 Drawing Sheets

FCC PROCESS WITH TOTAL CATALYST BLENDING

CROSS-REFERENCE TO RELATED APPLICATIONS

This application is a divisional application of U.S. Ser. No. 08/125,723 which was filed on Sep. 24, 1993, now U.S. Pat. No. 5,346,613, the contents of which are hereby incorporated by reference.

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to the routes of catalyst transfer and feed and catalyst contacting.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively.

Despite the long existence of the FCC process, techniques are continually sought for improving product recovery both in terms of product quantity and composition, i.e. yield and selectivity. Two facets of the FCC process that have received attention are recovery of adsorbed products from the spent FCC catalyst and initial contacting of the FCC feed with the regenerated catalyst. Improvement in the recovery of hydrocarbons from spent catalyst directly improves yields while better initial feed and catalyst contacting tends to benefit yield and selectivity.

A variety of devices and piping arrangements have been employed to initially contact catalyst with feed. U.S. Pat. No. 5,017,343 is representative of devices that attempt to improve feed and catalyst contacting by maximizing feed dispersion. Another approach to improved feed and catalyst contacting is to increase the penetration of the feed into a flowing stream of catalyst. U.S. Pat. No. 4,960,503 exemplifies this approach where a plurality of nozzles rings an FCC riser to shoot feed into a moving catalyst stream from a multiplicity of discharge points. While these methods do improve feed distribution of the feed into the hot regenerated catalyst stream, there is still a transitory period of poor distribution when the relatively small quantities of the hydrocarbon feed disproportionately contact large quantities of hot catalyst. This poor thermal distribution results in non-selective cracking and the production of low value products such as dry gas.

A different approach to feed and catalyst contacting reduces local temperature maldistribution when mixing hot catalyst with the feed. U.S. Pat. No. 4,960,503 teaches indirect heating of the feed with the hot catalyst before contacting the feed with the regenerated catalyst in a reaction zone. By raising the temperature of the feed, less feed heating is required as the catalyst and feed are combined. Heating of the feed by indirect heat exchange with the catalyst can cause coking in the heat exchange equipment.

In addition to improving initial feed and catalyst contacting, more complete stripping of hydrocarbons from the spent catalyst offers further advantages. More complete stripping removes hydrocarbons from the catalyst that are lost by combustion when the spent catalyst enters the regeneration zone. Common methods to more completely strip catalyst raise the temperature of the spent catalyst in the stripping zone as a means of desorbing hydrocarbons from spent catalyst prior to regeneration. One system for heating spent catalyst in the stripping zone employs indirect heat transfer. A more common method of heating spent catalyst in the stripping zone mixes higher temperature regenerated catalyst with the spent catalyst in the stripping zone. U.S. Pat. Nos. 3,821,103 and 2,451,619 describe systems for direct heating of spent catalyst with hot regenerated catalyst.

Aside from increasing hydrocarbon recovery, reducing the carryover of hydrocarbons into the regeneration zone improves the overall heat balance of the FCC unit. Hydrocarbon that enters the regeneration zone releases additional high temperature heat as it burns in the oxygen atmosphere. Any additional heat release in the regenerator interferes with the regenerator operation by raising temperatures in the regeneration zone or requiting cooling methods to maintain a suitable temperature.

The processing of increasingly heavier feeds and the tendency of such feeds to elevate coke production makes the control of regenerator temperatures difficult. Optimization of feedstock conversion is ordinarily thought to require essentially complete removal of coke from the catalyst. This essentially-complete removal of coke from catalyst is often referred to as complete regeneration. Complete regeneration produces a catalyst having less than 0.1 and preferably less than 0.05 weight percent coke. In order to obtain complete regeneration, oxygen in excess of the stoichiometric amount necessary for the combustion of coke to carbon oxides is charged to the regenerator. Excess oxygen in the regeneration zone will also react with carbon monoxide produced by the combustion of coke, thereby yielding a further evolution of heat.

Apart from the objective of minimizing dilute phase CO combustion, the increase in coke on spent catalyst results in a larger amount of coke being burned in the regenerator per pound of catalyst circulated. Heat is removed from the regenerator in conventional FCC units in the flue gas, and principally in the hot regenerated catalyst stream. An increase in the level of coke on spent catalyst will increase the temperature difference between the reactor and the regenerator, and the regenerated catalyst temperature overall. A reduction in the amount of catalyst circulated is, therefore, necessary in order to maintain the same reactor temperature. However, as discussed above the lower catalyst circulation rate required by the higher temperature difference between the reactor and the regenerator will lower hydrocarbon conversion, making it necessary to operate with a higher reactor temperature in order to maintain conversion at the desired level. This will cause a change in yield structure which may or may not be desirable, depending on what products are required from the process. Also, there are limitations to the temperatures that can be tolerated by FCC catalyst without having a substantial detrimental effect on catalyst activity. Generally, with commonly available modem FCC catalyst, temperatures of regenerated catalyst are usually maintained below 760° C. (1400° F.), since loss of activity would be very severe at about 760°–790° C. (1400°–1450° F.). If a relatively common reduced crude such as that derived from Light Arabian crude oil was charged to a conventional FCC unit, and operated at a temperature required for high conversion to lighter products, i.e., similar to that for a gas oil charge, the regenerator temperature would operate in the range of 870°–980° C. (1600°–1800° F.).

Restricting catalyst circulation to the reactor side of the FCC process affects more than yield structure of the products. The circulation rate of catalyst to the reactor influences the catalyst circulation rate through the regenerator. A decrease in the circulation of catalyst to the reactor can also lower the overall catalyst circulation rate through the regenerator. The use of additional conduits such as a recirculation line that transfers catalyst from the outlet of the regeneration zone to the inlet of the regeneration zone can reduce the interdependency of catalyst circulation through the reactor and regeneration zone. However, the use of a recirculation conduit complicates regulation of the catalyst circulation through the process and necessitates the maintenance of additional catalyst inventory on the reactor and regenerator side of the process to provide a buffer for variations in catalyst circulation. Thus, the reactor and regenerator operate with two interdependent catalyst circulation loops.

It is an object of this invention to improve the initial mixing of catalyst with the hydrocarbon feed in an FCC process.

It is a further object of this invention to fully integrate the mixing of regenerant and spent catalyst into a hot stripping operation for an FCC process.

A further object of this invention is to decouple the catalyst circulation on the regeneration side of the process from catalyst circulation on the reactor side of the process.

Another object of this invention is to reduce the amount of catalyst inventory maintained in an FCC process.

SUMMARY OF THE INVENTION

This invention decouples the circulation of catalyst on the regeneration side of the process from the circulation of catalyst on the reactor side of the FCC process by mixing the spent and regenerated catalyst from the reactor and regenerator side of the process in a common blending vessel that supplies blended catalyst to raise the solids to oil ratio on the reaction side of the process and regulate catalyst temperatures on the reaction and the regeneration sides of the process. The blending vessel can also retain the majority of the catalyst inventory for both the reactor and regenerator sides of the process. Moreover, by the introduction of a stripping gas into the blending vessel it operates as a hot stripper to remove additional hydrocarbons from the blended catalyst that enters the regeneration zone and inert gases from the blended catalyst that enters the reaction zone. The blended catalyst also has a relatively high temperature which benefits the process by allowing rapid initiation of coke combustion in the regeneration zone.

The blending vessel, by operating as a central holding and mixing zone for all catalyst streams that enter and exit the reactor and regenerator side of the process, completely decouples the circulation of catalyst on the regenerator side from the circulation of catalyst on the reactor side. Catalyst addition and withdrawal on the reactor side is completely balanced by the blending vessel as is catalyst circulation through the regenerator side of the process. Increasing catalyst circulation on the regenerator side of the process will serve to lower the average coke content on catalyst that is withdrawn from the blending vessel. In this manner, catalyst turnover on the regenerator side of the process may take place in a fraction of the time that it takes for catalyst turnover on the reactor side of the process. Therefore, the average coke content of the blended catalyst stream entering the reaction zone may be varied. Accordingly, coke on catalyst, catalyst temperature and catalyst circulation may be controlled independently while yet having the advantages of a hot stripping operation, low catalyst inventory, and improved feed and catalyst contacting.

Combining both regenerated and spent catalyst in the blending vessel increases the solids to feed ratio in the reaction zone. A greater solids ratio improves catalyst and feed contacting. Since the spent catalyst still has activity, the catalyst to oil ratio is increased. Moreover, the larger quantity of catalyst more evenly and quickly distributes the heat to the feed. In addition, the larger amount of catalyst transfers heat to the catalyst at a reduced temperature differential between the catalyst and the feed. Together both of these effects lead to more uniform feed and catalyst contacting and a resulting decrease in dry gas production.

Accordingly, in one embodiment, this invention is a process for the fluidized catalytic cracking of hydrocarbons. The process passes regenerated catalyst from a regeneration zone into a blending zone and spent catalyst from a reaction zone into the blending zone. Fluidization of the spent and regenerated catalyst in the blending zone produces a blended catalyst comprising a mixture of spent and regenerated catalyst. The process passes a portion of the regenerated catalyst to the reaction zone and contacts the portion of blended catalyst with a hydrocarbon-containing feedstream in the reaction zone to crack hydrocarbons and deposit coke on the blended catalyst. Contact of the blended catalyst with the feedstream produces spent catalyst and hydrocarbon products which are separated from the spent catalyst. The process passes another portion of the blended catalyst to the regeneration zone and contacts the blended catalyst with an oxygen-containing regeneration gas to combust coke from the blended catalyst and produce regeneration gas and regenerated catalyst. The regeneration gas is separated from the regenerated catalyst which again enters the blending zone.

In another embodiment, this invention is a process for the fluidized catalytic cracking of hydrocarbons. The process comprises passing regenerated catalyst from a regeneration zone into a downstream stripping zone and passing spent catalyst from the upstream stripping zone into the downstream stripping zone. Contact of the spent and regenerated catalyst with the stripping gas in the downstream stripping zone produces a stripper product stream and blends the regenerated and spent catalyst into a blended catalyst stream. A first portion of the blended catalyst stream passes through a riser reaction zone for contact with a hydrocarbon-containing feedstream. Contact of the catalyst with the feedstream cracks hydrocarbons and deposits coke on the blended catalyst to produce spent catalyst and hydrocarbon products. The process separates the catalyst from the hydrocarbon product stream and discharges the spent catalyst into the upstream stripping zone wherein contact with a stripping gas removes additional hydrocarbons from the spent catalyst. A second portion of the blended catalyst passes through the regeneration zone and contacts an oxygen-containing regeneration gas which combusts coke from the blended catalyst to produce regeneration gas and regenerated catalyst. The regenerated catalyst is separated from the regeneration gas to produce regenerated catalyst for return to the downstream stripping zone.

In an apparatus embodiment of this invention, the apparatus comprises a reaction chamber, a regeneration vessel, and a blending vessel. A spent catalyst conduit communicates spent catalyst from the reaction chamber to the blending vessel. A regenerated catalyst conduit communicates regenerated catalyst from the regenerator vessel to the blending vessel. A first blended catalyst conduit takes blended catalyst from the blending vessel and delivers it to the reaction chamber. A second blended catalyst conduit communicates blended catalyst from the blending vessel to the regeneration vessel. Means are provided for passing an oxygen-containing gas into the regeneration vessel and recovering a flue gas from the regeneration vessel. Means are also provided for passing a hydrocarbon-containing feedstream to the reaction chamber and recovering a hydrocarbon product stream from the reaction chamber. The apparatus also contains means for passing a fluidizing gas into the blending vessel for blending the regenerated catalyst and spent catalyst.

Additional objects, embodiments, and details of this invention will become apparent from the following detailed description.

DETAILED DESCRIPTION OF THE INVENTION

Figure 1:
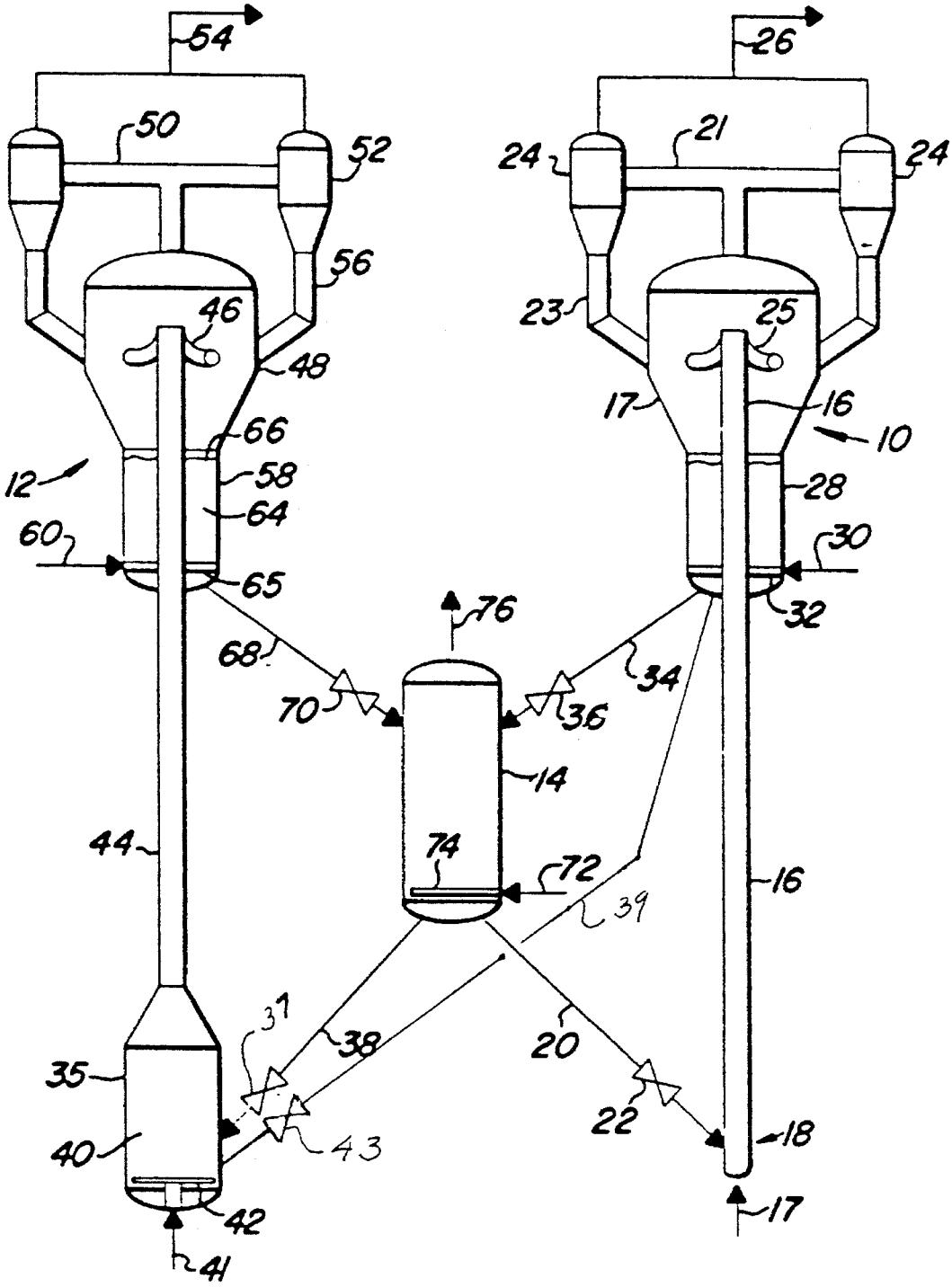
FIG. 1 is an elevation view showing a schematic cross section of an FCC reactor and regenerator designed in accordance with this invention.

The description of this invention in the context of specific embodiments is not meant to limit the scope of this invention to those embodiments shown herein.

This invention is more fully explained in the context of an FCC process. The drawing of this invention shows a typical FCC process arrangement. The description of this invention in the context of the specific process arrangement shown is not meant to limit it to the details disclosed therein. The FCC arrangement shown in FIG. 1 consists of a reactor 10, a regenerator 12, a blending vessel 14, and an elongate riser reaction zone 16. The arrangement circulates catalyst and contacts feed in the manner hereinafter described.

The catalyst that enters the riser can include any of the well-known catalysts that are used in the art of fluidized catalytic cracking. These compositions include amorphous-clay type catalysts which have, for the most pan, been replaced by high activity, crystalline alumina silica or zeolite containing catalysts. Zeolite catalysts are preferred over amorphous-type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, alumina, or zirconium. These catalyst compositions may have a zeolite content of 30% or more.

FCC feedstocks, suitable for processing by the method of this invention, include conventional FCC feeds and higher boiling or residual feeds. The most common of the conventional feeds is a vacuum gas oil which is typically a hydrocarbon material having a boiling range of from 650°–1025° F. and is prepared by vacuum fractionation of atmospheric residue. These fractions are generally low in coke precursors and the heavy metals which can deactivate the catalyst. Heavy or residual feeds, i.e., boiling above 930° F. and which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to a desired degree by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst makeup required to maintain constant activity. The contaminant metals include nickel, iron, and vanadium. In general, these metals affect selectivity in the direction of less gasoline and more coke. Due to these deleterious effects, the use of metal management procedures within or before the reaction zone are anticipated in processing heavy feeds by this invention. Metals passivation can also be achieved to some extent by the use of an appropriate lift gas in the upstream portion of the riser.

Aside from blending catalyst, an added benefit of this invention is the use of the blending vessel as a metals passivation zone. The blending vessel holds catalyst for a relatively long residence time. The blending vessel can also isolate passivation gas streams from the reactor and regenerator sides of the process. Therefore, the blending vessel can simultaneously serve as a passivation zone.

Looking then at the reactor side of FIG. 1, FCC feed from a conduit 17 is mixed with an additional fluidizing medium from line 18, in this case steam, and charged to the lower end of riser 16 that serves as a combustion chamber. A combined stream of feed and fluidizing medium are contacted with catalyst that enters the riser through blended catalyst conduit 20 in an amount regulated by a control valve 22. Although the drawing shows contact of the feed and catalyst at the initial point of catalyst entry, feed may also be added at a more downstream riser location and the catalyst initially transported up the riser by a suitable lift gas. Prior to contact with the catalyst, the feed will ordinarily have a temperature in the range of from 300° to 600° F.

Blending the spent and regenerated catalyst in the manner of this invention typically increases the relative amount of catalyst that contacts the feed. The amount of blended catalyst that contacts the feed will vary depending on the temperature of the blended catalyst and the ratio of spent to regenerated catalyst comprising the catalyst blend. Generally, the ratio of blended catalyst to feed will be in ratio of from 5 to 25. The term "blended catalyst" refers to the total amount of solids that contact the feed and include both the regenerated catalyst from the regenerator and the spent catalyst from the reactor side of the process. Preferably, the blended catalyst to feed will be in a ratio of from 10 to 20 and more preferably in ratio of from 10 to 15.

This higher ratio of catalyst to feed promotes more rapid vaporization of the feed and increases the catalyst surface area in contact with the feed to make vaporization more uniform. Both of theses effects promote a more uniform distribution of feed through the riser. The greater quantity of catalyst reduces the added heat per pound of catalyst for raising the temperature of the entering feed so that a high feed temperature is achieved with less temperature differential between the feed and the catalyst. Reduction of the temperature differential between catalyst and feed prevents shattering of the dispersed oil droplets and replaces violent mixing with the more complete contacting offered by the elevated volume of catalyst.

The temperature of the blended catalyst entering the riser usually ranges from 1000° to 1400° F. and more preferably is in a range of from 1050° to 1250° F. As the feed and catalyst mixture travels up the riser, the feed components are cracked and the mixture achieves a constant temperature. This temperature will usually be at least 900° F. Conditions within the riser usually include a catalyst density of less than 30 lb/f$^3$.

The catalyst and reacted feed vapors are then discharged from the end of riser 16 and separated into a product vapor stream and a collection of catalyst particles covered with substantial quantities of coke and generally referred to as spent catalyst. A series of cyclones 24 remove catalyst particles from the product vapor stream to reduce particle concentrations to very low levels. Cyclone separators are not a necessary part of this invention. This invention can use any arrangement of separators to remove spent catalyst from the product stream.

FIG. 1 shows a specialized arrangement for the separation of the product vapors from the spent catalyst. This arrangement locates cyclones 24 externally to a reactor vessel 17 that serves as an initial zone of catalyst and product disengagement. A swirl arm arrangement, provided at the end of riser 16 further enhances initial catalyst and product separation by imparting a tangential velocity to the exiting catalyst and product mixture. Such swirl arm arrangements are more fully described in U.S. Pat. No. 4,397,738 the contents of which are hereby incorporated by reference. Product vapors and some catalyst exit the top of reactor vessel 17 through a conduit 21. Cyclones 24 separate additional catalyst from product vapors and return the separated catalyst to the reactor vessel through dip leg conduits 23.

Product vapors are transferred to a separation zone for the removal of light gases and heavy hydrocarbons from the products. Product vapors are taken from cyclones 24 by a product conduit 26 and transferred directly to a main column (not shown) that contains a series of trays for separating heavy components such as slurry oil and heavy cycle oil from the product vapor stream. Lower molecular weight hydrocarbons are recovered from upper zones of the main column and transferred to additional separation facilities or gas concentration facilities.

Catalyst separated from the product feed vapors drops to the bottom of reactor vessel 17 into a stripping section 28 located upstream of the blending vessel that removes adsorbed hydrocarbons from the surface of the catalyst by countercurrent contact with steam. Steam enters the stripping zone 28 through a line 30 and a distribution ring 32. One stream of spent catalyst, stripped of hydrocarbon vapors, leaves the bottom of stripper 28 through a spent catalyst standpipe 34 at a rate regulated by a control valve 36 and enters blending vessel 14. Another stream of spent catalyst may be transferred directly to regenerator 12 via a spent catalyst standpipe 39 at a rate regulated by a control valve 43.

Turning next to the regenerator side of the process as shown in FIG. 1, regenerator 12 removes coke deposits from blended catalyst. Catalyst enters a lower combustor 35 of regenerator 12 through a line 38 which directs the catalyst into a fast fluidized zone 40 contained in combustor 35. A control valve 37 regulates the rate of addition of catalyst from blending vessel 14 into combustor 35. Air entering via line 41 supplies oxygen-containing gas which distributor 42 distributes over the cross-section of combustor 35. The upward flow of air through combustor 40 creates the fast fluidized conditions by transporting the catalyst upwardly at a velocity of between 8 to 25 ft/sec and at a density in a range of from 4 to 34 lbs /ft$^3$. Due to the blending of catalyst in vessel 14, as hereinafter described, catalyst entering the combustor vessel typically has relatively higher temperature than the typical FCC spent catalyst stream. Contact with the oxygen-containing gas under the fast fluidized condition initiates combustion of coke from the catalyst.

The catalyst and gas mixture passes from the combustion zone 40 into a combustion riser 44. The reduction in flowing diameter from combustion zone 40 to riser 40 accelerates the catalyst. Typical catalyst velocity in the combustion riser is in a range of from 20 to 70 ft/sec. and catalyst traveling up the riser usually has a density in a range of from 2 to 4 lbs/ft$^3$.

Residence time through the combustor and riser will usually provide sufficient reaction time to completely combust coke and fully regenerate the catalyst i.e., removal of coke to less than 0.1 wt. %. In addition, catalyst and gas residence time through the combustor and riser can also be set to obtain a complete combustion of CO to $CO_2$. This invention permits adjustment of the catalyst circulation rate and coke on catalyst to obtain complete catalyst regeneration, and complete CO combustion if desired, in the combustor and riser. Increasing the catalyst circulation rate on the regenerator side of the process will lower the amount of coke entering the combustor by the amount necessary to obtain complete catalyst regeneration and CO combustion.

The top of riser 44 contains a swirl arm arrangement 46. The arm arrangement 46 operates in the same manner as the swirl arm arrangement 25 in the reactor. Tangential velocity imparted to the exiting catalyst and gas from arm arrangement 46 again produces an initial separation of catalyst from gas in disengaging vessel 48. A conduit 50 carries gas separated in disengaging vessel 48 overhead to cyclone separators 52. Again, in an arrangement similar to that described in conjunction with the reactor vessel, cyclones 52 are located externally to disengaging vessel 48. Locating cyclones 52 outside of disengaging vessel 48 reduces the overall volume and corresponding catalyst inventory of the regeneration zone. A line 54 withdraws combustion gas, now relatively free of catalyst and transfers the combustion gases for further processing or treating before discharge to the atmosphere. Such processing can include removing of ultra fine particulate material and the recovery of sensible heat.

Catalyst removed by cyclone separators 52 returns to disengaging vessel 48 via diplegs 56. Catalyst from disengaging vessel 48 collects in a collection zone 58 of regenerator 12. Additional oxygen-containing gas is compressed and transferred into zone 58 through line 60. Line 60 communicates the air to a distributor 65 that disperses the air over the cross-section of zone 58. Dispersal of the air maintains a dense catalyst bed 64 and establishes an upper bed surface 66. For the purpose of this invention, a dense catalyst bed is defined as having a density of at least 10 lb/ft$^3$ and more typically a density in a range of from 30 to 40 lb/ft$^3$. The elevation of bed surface 66 is determined by the mount of air that enters zone 58 and the quantity of catalyst maintained in the zone 58. Small amounts of hot catalyst are entrained in air and combustion gases rising out of bed 64 are carried above bed surface 66. The small amounts of entrained catalyst are separated by the cyclones 52 and returned to catalyst bed 64. A regenerator standpipe 68 withdraws hot catalyst, usually in a temperature range of from about 1100° to 1400° F., from bed 64. The preferred range for the regenerated catalyst is from 1200° to 1400° F.

Regenerator standpipe 68 supplies hot catalyst to the blending vessel 14 at a rate regulated by control valve 70. In addition to the regenerated catalyst from standpipe 68, the spent catalyst from standpipe 34 also enters mixing vessel 14. Fluidization gas, entering vessel 14 from a line 72 and distributed by a distributor 74, promotes mixing of catalyst within the vessel. The amount of fluidizing gas entering the blending zone will have establish a superficial velocity of between 1 to 3. The blending vessel will ordinarily maintain a dense catalyst bed. Conditions within the blending zone typically include a density in a range of from 30 to 40 lb/ft$^3$. Turbulent mixing within the dense catalyst bed fully blends the regenerated and spent catalyst. In this manner, mixing vessel 14 operates at least as a blending zone to supply the blended catalyst streams to the reactor and regenerator.

The blending zone may also provide other process functions. For example, the blending zone can be used as an added stage of stripping. Stripping provides a particularly beneficial use of the blending zone. The blending of regenerated catalyst typically elevates the temperature of the blended catalyst so that a stripper blending zone provides hot stripping. Additionally, entrained inert gases from the regeneration step can be stripped from the catalyst in the blending vessel. In a further use of the blending zone, line 72 may also charge a secondary feed to the blending vessel which may operate as a secondary reactor. It is even possible to use blending vessel 14 as an additional stage of regeneration by passing an oxygen-containing gas to the regeneration zone. Thus, the fluidizing gas entering through line 72 may comprise air, steam, additional feedstreams, etc.

A vent line 76 passes fluidizing gas out of the top of mixing vessel 14. Depending on its composition, the fluidizing gas may be passed back into the reactor for recovery of additional product vapors, processed separately to recover a secondary product stream or returned to the regeneration zone and combined with the flue gas stream exiting the regenerator.

Regenerated and spent catalyst from standpipes 68 and 34 may enter mixing zone 14 in any proportion. Ordinarily, the ratio of spent catalyst to regenerated catalyst entering the blending zone will be in a range of from 0.5 to 2. The mass of blended catalyst withdrawn by standpipes 20 and 38 normally balances with the mass of catalyst entering blending zone 14 through lines 20 or 38 is balanced by the amount of catalyst entering the blending vessel through the standpipes 34 and 68, respectively. Changes in the catalyst mass balance across the standpipe pair 34 and 20 and standpipe pair 68 and 38 will vary the catalyst inventory in one or all of the regenerator, reactor and blending vessels. Normally blending zone 14 will retain the majority of the catalyst inventory in the FCC arrangement. Using the blending zone to primarily retain excess catalyst reduces the overall catalyst inventory in the process unit.

Figure 2:
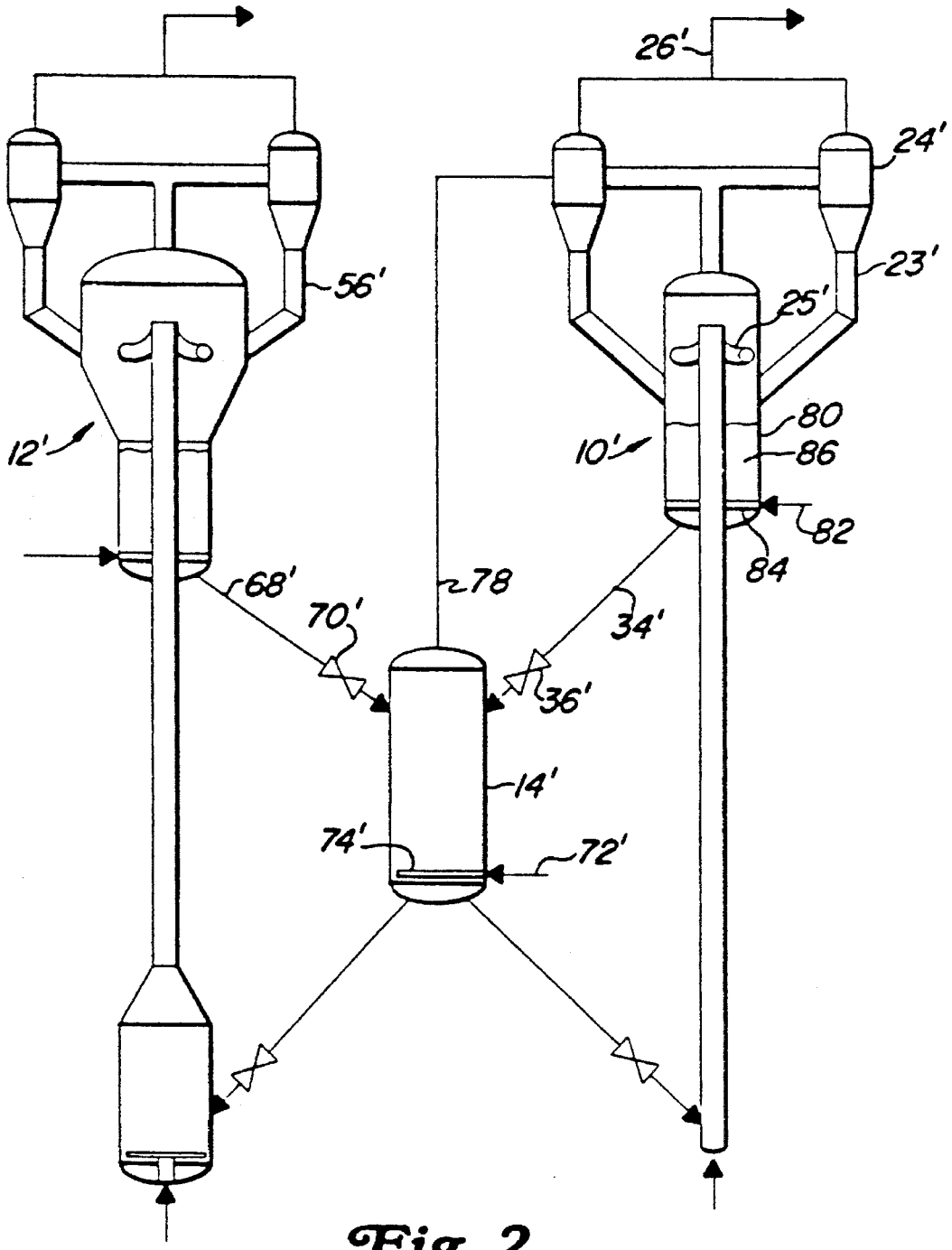
FIG. 2 is an modified elevation view of the FCC reactor and regenerator arrangement shown in FIG. 1.

FIG. 2 shows such an arrangement where the blending zone minimizes the catalyst inventory of the FCC process and provides a downstream stripping vessel 14'. FIG. 2 also shows a modified reaction zone 10' having a disengaging vessel 80 which also provides catalyst stripping upstream of vessel 14'. A small quantity of stripping medium enters a reactor vessel 80 via conduit 82. Distributor 84 distributes the stripping medium and creates a dense bed 86 retained in the bottom of stripping vessel 80. Only a small quantity of stripping fluid is usually charged to reactor vessel 80. The primary function of dense bed 86 is to provide a quick initial separation of product gas from the catalyst. This can be accomplished with a relatively small mount of stripping gas. Usually stripping gas in an amount equal to 0.05 to 0.3 wt. % of the catalyst passing through vessel 86 is charged to line 82. In this manner vessel 80 provides a pre-stripping function that is useful in removing noncondensable hydrocarbons from the catalyst. The pre-stripping function removes hydrocarbon vapors primarily from void spaces between the catalyst. Higher density hydrocarbons with multi-ring structures are then removed in the downstream stripping zone having a higher temperature provided by the regenerated catalyst and a longer residence time.

More complete stripping of the spent catalyst takes place in the stripping vessel 14'. Stripping gas, typically steam, enters downstream stripping vessel 14' through a line 72' and is distributed by distributor 74'. Stripping vapors and stripped hydrocarbons are taken overhead from the stripping zone through a line 78 and returned to external cyclones 24'. Due to the higher temperature and longer residence time, a greater amount of hydrocarbon products are often recovered in the downstream stripping zone contained within vessel 14'. Preferably line 78 passes the stripping gases directly to cyclones 24. External cyclones 24 remove any entrained hydrocarbons from the stripping gases carried by line 78. Hydrocarbon products are then recovered by the usual separation facilities via product line 26'. Blended catalyst from downstream stripping zone 14' is again transferred to a regeneration vessel 12' that operates in the same manner as the regenerator previously described in conjunction with FIG. 1.

Reactor vessel 80 has a very low volume. The low volume reduces the residence time between product vapors and catalyst and provides a quick separation. A quick separation of product vapors from the catalyst eliminates overcracking and reduces the production of dry gas. Hydrocarbon products and catalyst discharged from riser end 25' again receive a tangential velocity to initially separate catalyst from the hydrocarbon vapors while cyclones 24' further separate entrained catalyst particles from the recovered hydrocarbon products. The low volume of reactor vessel 80 permitted by external cyclones 24' again promotes rapid separation of hydrocarbon vapors from catalyst to minimize residence time and also reduces catalyst inventory. The low volume of vessel 80 also minimizes catalyst inventory.

Aside from the low volume of vessel 80, the overall arrangement depicted by FIG. 2 lowers catalyst inventory. In regular operation stripping vessel 14' retains any catalyst inventory. Small amounts of catalyst may be retained in regenerator 12' and vessel 80 to disengage gases from the catalyst before regenerated catalyst or spent catalyst enters stripping vessel 14'. A catalyst bed may also be required in regenerator 12' or vessel 80 to seal the regenerator cyclone dip legs 56' or the reactor cyclone dip legs 23'. Control valves 70' and 36' regulate the flow of catalyst out of regenerator 12' and vessel 80 via conduits 68' and 43'.

Preferably the control valves will maintain the minimum bed height or catalyst volume in regenerator 12' and vessel 80'.

In some cases circumstances it may be possible to operate the FCC arrangement without one or both of control valves 70' and 34'. The absence of the valves allows catalyst to flow freely through its respective conduit, i.e., standpipes 34' or 68'. If the respective control valve is removed, reactor 10' or regenerator 12' will not hold any catalyst inventory. Elimination of the catalyst bed in this manner may require an alternate means of sealing the cyclone dip legs such as a weighted flapper valve. Removal of both control valves would also cause the vessel 80, regenerator 12' and stripper 14' to operate at essentially the same pressure. In most instances it would be impractical to operate the system with all three vessels at the same pressure and usually at least one of conduits 68' and 34' will have a control valve located therein.

The reactor and regenerator arrangement shown in FIGS. 1 and 2 may also benefit from external heat removal. Such external heat recovery systems include well known arrangements such as catalyst coolers and remove heat by indirect heat exchange. Where a catalyst cooler is employed it will typically receive catalyst from and return catalyst to the regenerator side of the process where temperatures are the highest. The higher temperatures associated with the regenerator side of the process ordinarily improve the efficiency of the heat removal apparatus. However, catalyst entering blending vessel 14 or downstream stripping zone 14' may also circulate through a heat exchanger for heat recovery. Accordingly catalyst for cooling may exit either the regeneration zone or the blending zone and return either to the regeneration zone or the blending zone.

What is claimed is:

1. An apparatus for the fluidized catalytic cracking of hydrocarbons, said apparatus comprising:

a reaction chamber;

a regeneration vessel;

a blending vessel;

a spent catalyst conduit for communicating spent catalyst from said reaction chamber to said blending vessel;

a regeneration catalyst conduit for communicating regenerated catalyst from said regenerator vessel to said blending vessel;

a first blended catalyst conduit for communicating blended catalyst from said blending vessel to said reaction chamber;

a second blended catalyst conduit for communicating blended catalyst from said blending vessel to said regeneration vessel;

means for passing an oxygen-containing gas into said regeneration vessel; means for recovering a flue gas from said regeneration vessel;

means for passing a hydrocarbon containing feedstream to said reaction chamber; means for recovering a hydrocarbon product stream from said reaction chamber; and, means for passing a fluidizing gas into said blending vessel for blending regenerated catalyst and spent catalyst.

2. The apparatus of claim 1 wherein said regeneration zone includes a combustor riser for contacting said spent catalyst with said oxygen-containing gas.

3. The a apparatus of claim 1 wherein said blending vessel includes means for recovering a stripper product stream from said blending vessel.

4. The apparatus of claim 1 wherein said reaction chamber comprises a reactor riser conduit.

5. The apparatus of claim 4 wherein a reactor vessel surrounds an outlet of said reactor riser conduit and a cyclone separator is located outside of said reactor vessel and said cyclone separator communicates with said reactor vessel to separate spent catalyst from said hydrocarbon product stream to provide a portion of said means for recovering a hydrocarbon product stream.

6. The apparatus of claim 1 wherein a cyclone separator is located outside of said regenerator vessel and communicates with said regenerator vessel to provide a portion of said means to separate regenerated catalyst from said flue gas.

7. The apparatus of claim 5 wherein said reactor vessel comprises a disengaging vessel and a riser conduit located inside said disengaging vessel and said riser conduit includes means for tangentially discharging a spent catalyst and hydrocarbon product stream.

8. The apparatus of claim 5 wherein said means for recovering said stripper product stream comprises a conduit communicating said blending vessel with said cyclone separator.

9. The apparatus of claim 5 wherein said a stripper vessel is located adjacent to said reactor vessel, below said reactor vessel and in communication with said reactor vessel and said spent catalyst conduit communicates with said stripper vessel.

* * * * *